US005190843A

United States Patent [19]

Noda et al.

[11] Patent Number: 5,190,843

[45] Date of Patent: Mar. 2, 1993

[54] METHOD AND APPARATUS FOR DEVELOPING ELECTROSTATIC LATENT IMAGES

[75] Inventors: Nobutaka Noda; Kazuo Hamamura, both of Yokohama; Tetsuo Murase, Kawasaki, all of Japan

[73] Assignee: Katsuragawa Electric Co., Ltd., Japan

[21] Appl. No.: 548,864

[22] Filed: Jul. 6, 1990

[30] Foreign Application Priority Data

Jul. 10, 1989 [JP] Japan ..... 1-177550

[51] Int. Cl.[5] ..... G03G 13/24; G03G 13/01

[52] U.S. Cl. ..... 430/122; 355/253; 355/265; 118/657

[58] Field of Search ..... 355/253, 265; 118/657; 430/122

[56] References Cited

U.S. PATENT DOCUMENTS

| | | | |
|---|---|---|---|
| 4,231,220 | 11/1980 | Asanae et al. | 118/657 |
| 4,235,194 | 11/1980 | Wadu et al. | 355/253 X |
| 4,309,498 | 1/1982 | Yamashita et al. | 430/100 |
| 4,447,517 | 5/1984 | Yuge et al. | 430/122 |
| 4,553,500 | 11/1985 | Itaya et al. | 118/657 |
| 4,559,899 | 12/1985 | Kan et al. | 118/657 |
| 4,669,852 | 6/1987 | Tijima et al. | 118/653 X |
| 4,674,439 | 6/1987 | Sakamoto et al. | 118/657 |
| 4,789,612 | 12/1988 | Haneda et al. | 430/45 X |
| 4,913,288 | 4/1990 | Kanbe et al. | 355/265 X |
| 4,935,784 | 6/1990 | Shigehivo et al. | 355/253 |

FOREIGN PATENT DOCUMENTS

| | | |
|---|---|---|
| 58-184158 | 10/1983 | Japan . |
| 59-24416 | 6/1984 | Japan . |
| 61-73973 | 4/1986 | Japan . |
| 62-184474 | 8/1987 | Japan . |

*Primary Examiner*—Marion E. McCamish
*Assistant Examiner*—S. Rosasco
*Attorney, Agent, or Firm*—Venable, Baetjer & Howard

[57] ABSTRACT

A method for developing an electrostatic latent image comprises the steps of attracting a developer comprised of a magnetic toner and a magnetic carrier onto the surface of a sleeve with a magnet roll disposed therein, rotating the magnet roll and the sleeve in the direction opposite to the rotational direction of an image carrier to move the developer in the same direction as the sleeve, and supplying the developer onto the image carrier under an alternating electrical field and an alternating magnetic field to thereby conduct development. An apparatus for effecting the method comprises a casing for accommodating the developer; the magnet roll arranged to be rotated in the direction opposite to the rotational direction of image carrier; the sleeve arranged to be rotated in the same direction as the magnet roll; and an alternating electrical field applying means.

2 Claims, 1 Drawing Sheet

METHOD AND APPARATUS FOR DEVELOPING ELECTROSTATIC LATENT IMAGES

BACKGROUND OF THE INVENTION

1. Field of the Invention

This invention relates to a method for developing electrostatic latent images and an apparatus for carrying out the method. More particularly, this invention relates to a method and an apparatus for developing an electrostatic latent image with a magnetic brush formed by a developer comprised of a high electrical resistance magnetic toner and a magnetic carrier to obtain a sharp copied image free from fogging.

2. Description

As the magnetic brush developing method, there are known and used two methods, that is, one being a method of development using monocomponent magnetic developer, and the other being a method of development using a two-component magnetic developer. The method of development using one-component developer is advantageous in that the construction of the developing apparatus is simple and its maintenance and repairs can be made readily. In particular, the methods of development using a magnetic toner, so-called, jumping developing method and selective developing method are advantageous in that very sharp copied images can always be obtained at low costs. On the other hand, however, in carrying such methods into effect, it is essential to provide a very close mechanical accuracy to component parts of the developing apparatus, and stating more specifically, it is required, for example, to maintain the clearance between an image carrier and a development sleeve (and the surface of a developer layer formed on the sleeve) over the whole length of the sleeve accurately at a predetermined value. Therefore, it is considerably difficult to meet such requirements in electrophotographic copying systems for forming large-sized copied images such as those of AO size which require the provision of a considerably long sleeve. For this reason, such a system has not yet been developed up to the present time.

Whilst, the method of development using a two-component developer can eliminate the above-mentioned disadvantage inherent to the developing method using monocomponent developer, however, it is disadvantageous in that it is necessary to control always the ratio of mixing toner and carrier such that it is kept in a predetermined range and periodically replace all the developer due to fatigue of the carrier or the like.

Still further, there is known a method of development using a developer comprised of a mixture of a magnetic carrier having a fine particle size and a non-magnetic toner. (see, for example, Japanese Laid-Open Patent Application No. SHO. 59-24416). The method of development disclosed in this publication of Japanese Patent Application comprises the steps of forming a developer brush with a magnetic developer which is comprised of a mixture of an electrically insulating magnetic carrier having a particle size of substantially 5 to 30 μm and an electrically insulating non-magnetic allowing the developer brush to rub the surface of an electrostatic latent image carrier under the influence of an alternating magnetic field to thereby develop the latent image.

According to the above-mentioned method of developing electrostatic latent images using the magnetic carrier of a fine particle size and the magnetic toner, developed images of a very high quality which are free from fogging can be obtained, and also some of the above-mentioned problems can be eliminated, however, there still remains a problem on control of the toner density wherein the ratio of mixing of toner with carrier must be maintained in a range of 6 to 35% by weight.

The present invention has been made in view of the above-mentioned circumstances in the prior art, and has for its object to provide a method for developing electrostatic latent images which eliminates substantially the need for controlling the density of toner and which enables an image having excellent sharpness and enhanced graduation and free from fog to be obtained, and also an apparatus for carrying out the method.

SUMMARY OF THE INVENTION

To achieve the above-mentioned object, according to one aspect of the present invention, there is provided a method for developing electrostatic latent images, characterized in that it comprises the steps of attracting a developer comprised of a high electrical resistance magnetic toner and a magnetic carrier onto the outer peripheral surface of a sleeve having a magnet roll disposed in the interior thereof, the magnet roll having magnetic poles of different polarities arranged alternately along the inner circumference of the sleeve, rotating the magnet roll and the sleeve in the direction opposite to the direction of rotation of an image carrier so as to move the developer in the same direction as the sleeve, and supplying the developer onto the surface of said image carrier under the influence of an alternating electrical field applied between the image carrier and the sleeve and an alternating magnetic field applied by the magnet roll to thereby develop an electrostatic latent image formed on the image carrier.

Stating more specifically, a most suitable effect can be obtained by (1) keeping the moving speed of the develope on the sleeve substantially equal to the moving or rotating speed of the image carrier, (2) setting the alternating magnetic field at a frequency which allows it to be applied at least once to magnetic toner while the same portion of the developer brush is kept in contact with the image carrier, and also (3) setting the alternating electrical field at a frequency which does not cause any beating phenomenon with the alternating magnetic field.

According to another aspect of the present invention, there is provided an apparatus for developing electrostatic latent images, characterized in that it comprises a casing located adjacent to an image carrier in the form of a rotary drum and adapted to accommodate a developer comprised of a high electrical resistance magnetic toner and a magnetic carrier: a magnet roll having magnetic poles of different polarities arranged alternately along the circumference thereof and arranged to be rotated in the direction opposite to the rotational direction of the image carrier a sleeve disposed so as to accommodate the magnet roll in the interior thereof and arranged to be rotated in the same direction as the magnet roll and independently of the same; and a means for applying an alternating electrical field between the image carrier and the sleeve.

According to such an apparatus, the magnetic toner on the sleeve will oscillate under the influence of the alternating electrical field and the alternating magnetic field. Stating more specifically, when the magnetic brush on the surface of the sleeve is brought into contact with the image carrier, the toner will reciprocate (or oscillate) between the image carrier and the surface of the sleeve. At that time, since an electrostatic latent image potential is applied onto the surface of the image carrier, the magnetic toner is electrostatically attracted by the Coulomb force only onto the portions of the image carrier corresponding to the electrostatic latent images. As compared with the prior art method of developing electrostatic latent images under the influence of a fixed magnetic field and a fixed potential, according to the method of development of the present invention, the toner is oscillated by a synergistic effect provided by an alternating electrical field and an alternating magnetic field so that the magnetic toner electrostatically attracted onto portions of the image carrier to which an electrostatic latent image potential is applied will provide a sharp copied image free from fogging. Further, when the high electrical resistance magnetic toner is mixed with the magnetic carrier, the toner is given a static charge due to friction therebetween so that enhanced attraction of the toner onto the electrostatic latent image is obtained, and also improvement in flowability of the developer can be achieved.

The above-mentioned and other objects, aspects and advantages of the present invention will become apparent to those skilled in the art from the following description and companying drawings in which a preferred embodiment incorporating the principles of the present invention is shown by way of example only.

DESCRIPTION OF THE PREFERRED EMBODIMENTS

Figure 1:
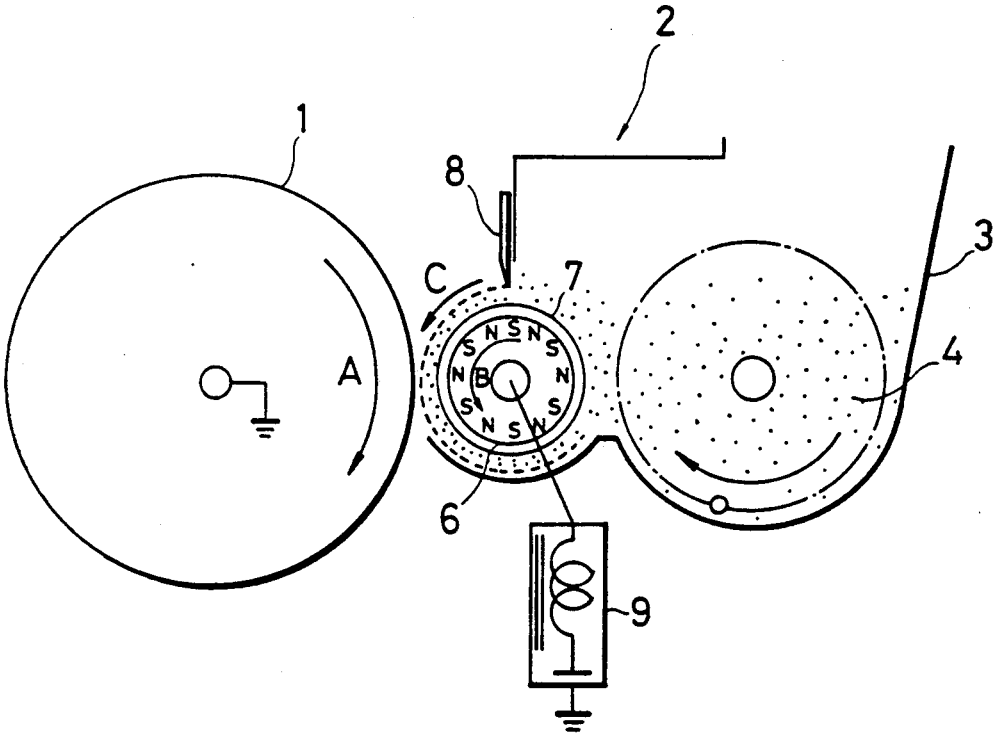
FIG. 1 is a schematic, side elevational view for explaining a method of developing an electrostatic latent image formed on the surface of an image carrier according to the present invention.

In the drawing (FIG. 1), reference numeral 1 denotes an image carrier or photosensitive drum which comprises a cylindrical drum having a photosensitive material such as Se or the like formed on the peripheral surface thereof, and which is arranged to be rotated at a predetermined peripheral speed in a direction shown by arrow "A", that is, clockwise in the drawing. The arrangement is made such that when the image carrier 1 is rotated an electrostatic latent image is formed on the surface of the image carrier 1 by a proper electrostatic latent image forming means, not shown. As the image carrier or photosensitive drum and the electrostatic latent image forming means, those having publicly known constructions adapted for use, for example, in Xerography can be used.

Disposed adjacent to the image carrier 1 is a developing apparatus 2 provided with a casing 3 in which a developer 4 comprised mainly of a magnetic toner is accommodated. As the magnetic toner, one having an electrical resistance of $10^{15}\Omega$ cm or more and containing 25% by weight or more, preferably 25 to 60% by weight of ferrite particles whose mean particle size is 5 to 15 microns is used. If the particle size of the ferrite particles is too small, then fogging occurs in the copied image, whilst if it is too large, then images of characters or letters will deteriorate in sharpness. For the purpose of development, a small quantity of a magnetic carrier is used so as to cooperate with the magnetic toner. The magnetic carrier should preferably be comprised of spherical particles having a particle size of several ten microns. The magnetic carrier is put to use after it is mixed with the magnetic toner, or alternatively it is put to use by applying it on the surface of a sleeve 7 in such an amount as to cover the surface uniformly so as to form a carrier layer prior to supplying the magnetic toner into the casing 3, and then supplying the magnetic toner to the carrier layer while rotating the sleeve 7 to thereby form a developer brush uniformly on the surface of the sleeve 7.

Located within the casing 3 on one side of the image carrier is a magnet roll 6 which extends adjacent to and in parallel with the image carrier 1. The magnet roll 6 has magnetic poles of different polarities (S, N) arranged alternately at approximately equal intervals in the circumferential direction thereof, and is arranged to be rotated in the direction opposite to the direction of rotation of the image carrier 1, that is, counterclockwise (shown by arrow B). Further, a non-magnetic cylindrical sleeve 7 is provided in such a way as to enclose the magnet roll 6 concentrically and in parallel thereto, and is arranged to be rotated in the same direction as the magnet roll 6, but independently of the same. The sleeve 7 is rotated at a speed enough to convey the developer in the rotational direction of the sleeve 7 against the force or tendency of moving the developer clockwise which is created by the magnetic field of the magnet roll 6. Stating more specifically, when the magnetic roll 6 is rotated in a direction shown by arrow B, the developer particles on the sleeve 7 tend to move on the surface thereof in the direction opposite to the rotational direction of the magnet roll 6 while they are rotating round their own axes. However, since the sleeve 7 is rotated at a speed higher than the speed of movement of the developer created by the effect of the magnetic field of the magnet roll 6 in a direction shown by arrow C, the developer on the sleeve 7 is moved in the same direction as the sleeve 7 against the effect of the magnet roll 6. The moving speed of the developer should preferably be substantially equal to the peripheral speed of the image carrier 1. The developer brush is conveyed in such a manner as to allow its soft brush portion to be kept in contact with the surface of the image carrier 1 or closely adjacent to the surface with a slight clearance kept therebetween. In such a contact or closely adjacent condition, the magnetic toner in the developer is subjected to the influence of an alternating magnetic field created by the rotation of the magnet roll 6 and an alternating electrical field which will be mentioned later so that it is reciprocated (or oscillated) between the surface of the image carrier 1 and the surface of the sleeve 7 so as to be puffed or transferred onto the electrostatic image zone on the image carrier 1 to thereby enable a sharp copied image to be obtained. Further, to enhance the developer carrying power of the sleeve 7, the surface of the sleeve 7 should preferably be treated by shot blasting etc. using beads having a particle size of less than 250 meshes.

The number of rotations of the magnet roll 6 should preferably be set at such a value as to correspond to a frequency which allows the alternating magnetic field to be applied at least once onto the toner while at least one and the same portion of the developer brush is kept in contact with the image carrier 1. For example, in case the number of magnetic poles of the magnet roll 6 is 10 and the peripheral speed of the image carrier 1 is 120 mm/sec, the frequency of the alternating magnetic field should preferably be more than 24 Hz. (120 mm (peripheral speed of image carrier 1) / approx. 5 mm (contact width of developer)=24) As mentioned hereinabove, the rotational speed of the sleeve 7 at that time is set so that the developer on the sleeve 7 is moved at a speed nearly equal to the peripheral speed of the image carrier 1. Further, in case the moving speed of the toner on the sleeve 7 is higher than the peripheral speed of the image carrier 1, scattering of toner tends to occur in front of a solid image on the copy sheet, whilst in case the former speed is lower than the latter, there is a tendency of the toner scattering behind the solid image. In case of developing linear images, the resolution of lateral lines tends to deteriorate in particular. In this case, a round image is copied in the form of an ellipse on a copy sheet. Further, the magnetic flux of the alternating magnetic field on the surface of the sleeve 7 should preferably be 500 gausses or more.

Reference numeral 8 denotes a doctor blade formed of a non-magnetic material and adapted to regulate the thickness of the developer brush to be formed. In case, for example, the spacing between the image carrier 1 and the sleeve 7 is set at about 0.7 mm, the spacing between the leading end of the doctor blade 8 and the sleeve 7 should preferably be set at about 0.4 mm.

Reference numeral 9 denotes an alternating current power supply adapted to apply an alternating electrical field between the sleeve 7 and the image carrier 1.

The frequency of the alternating electrical field is decided relative to the number of rotations of the magnet roll 6 and is preset at a value which does not cause beating (resonance) phenomenon with the alternating magnetic field applied by the magnet roll 6. Further, the alternating electrical field may be created by superimposing an alternating current bias on a direct current bias.

EXPERIMENTAL EXAMPLE

While an image carrier having SeTe photoconductive material vapor deposited thereon is moved at a peripheral speed of 140 mm/sec, an electrostatic latent image having a potential of 650 volts on dark portion and a potential of 100 volts on light portion was formed on the surface of the image carrier according to Xerography process. Whilst, a magnet roll 6 having 12 magnetic poles and a length of about 934 mm was used so as to create a magnetic flux of about 500 gausses on the surface of the sleeve 7. 120 grams of a magnetic carrier was previously applied onto the surface of the sleeve 7 having a diameter of 40 mm, and then a magnetic toner was supplied to the sleeve 7 to form a developer brush thereby conducting development of the electrostatic latent image. The spacing between the sleeve 7 and the leading end of the doctor blade 8 was set at 0.3 mm, while the spacing between the image carrier 1 and the sleeve 7 was set at 0.6 mm. The surface of the sleeve 7 was previously treated by shot blasting using glass beads having a particle size of 400 meshes. A bias created by superimposing an alternating current voltage having a frequency selected from a range of 100 to 2,000 Hz on a direct current voltage was applied to the surface of the sleeve 7.

The sleeve 7 and the magnet roll 6 were rotated in a direction opposite to the rotational direction of the image carrier 1 so as to cause the developer on the sleeve 7 to move at a speed of 12.5 mm per one revolution of the magnet roll 6 in the direction opposite to the rotational direction of the magnet roll 6 while the developer particles are rotating around their axes. At that time, the sleeve 7 was rotated at a speed higher than the moving speed of the developer. For example, if the magnet roll 6 is rotated at 600 r.p.m, the sleeve 7 is rotated at a peripheral speed of 125 mm/sec or more. Although a copied image of a certain level is obtained under this condition, to obtain a better copied image, the peripheral rotational speed of the image carrier 1 should be substantially equal to the moving speed of the developer. Experiments made so far revealed that it is one of significant requirements for obtaining a sharp copied image to set the moving speed of the developer in the range of 50 to 150% of the peripheral speed of the photosensitive drum. In case the peripheral speed of the photosensitive drum 1 is out of such a range, a round black original image will become elliptical one when it is developed, and the resolution of the image will deteriorate, thus causing trouble. The optimum frequency of the alternating current voltage is decided by the width of magnetized portions, the number of magnetic poles and the number of rotations of the magnet roll 6, and the peripheral speed of the image carrier 1. It is important to select a frequency which does not allow the alternating magnetic field applied by the magnet roll and the alternating electrical field applied by the alternating current voltage to cause beating phenomenon when development is made. As a result of development of an electrostatic latent image under the above mentioned conditions and at an alternating current bias voltage of 1,000 volts, a frequency of 800 Hz, a d.c. voltage of 150 volts, the number of rotations of magnet roll 6 of 500 rpm, and the number of rotations of sleeve 7 of 120 rpm, a copied image having a high resolution was obtained. At that time, a magnetic toner comprising as its main components an acrylic resin, about 45%, by weight of ferrite powder and a pigment and having an electrical resistance of $10^{15}\Omega$ cm was used. Further, in case a magnetic toner having an electrical resistance of less than $10^{15}\Omega$ cm was used, a fog occurred in a copied image.

Since, in such an arrangement, development of electrostatic latent images is made by a magnetic toner, it is unnecessary to effect control of the toner density which is required in case development is made by two-component magnetic developer. Regarding the carrier, there is almost no need of replenishing it after it is previously applied onto the surface of the sleeve as mentioned hereinabove.

As mentioned above, according to the method of development of the present invention, the advantage of the method of development using monocomponent high electrical resistance magnetic toner can be maintained and the disadvantage thereof can be eliminated, and a copied image which is excellent in sharpness and has a good graduation can be obtained without the needs for provision of close mechanical accuracy in component parts of a developing apparatus and for controls of the density of magnetic toner.

It is to be understood that the foregoing description is merely illustrative of preferred embodiments of the present invention, and that the scope of the present invention is not to be limited thereto, but is to be determined by the scope of appended claims.

What is claimed is:

1. A method for developing electrostatic latent images comprising the steps of:

(a) forming a developer brush by attracting a developer comprised of a high electrical resistance magnetic toner and a magnetic carrier onto the outer peripheral surface of a sleeve having a magnet roll disposed in the interior thereof, said magnet roll having magnetic poles of different polarities arranged alternately along the inner circumference of said sleeve;

(b) rotating said magnet roll and said sleeve in a direction opposite to the direction of rotation of an image carrier so that said developer on said sleeve moves in the same direction as said sleeve at a speed substantially equal to the peripheral speed of said image carrier; and (c) supplying said developer onto the surface of said image carrier under the influence of an alternating electrical field applied between said image carrier and said sleeve and an alternating magnetic field created by said magnet roll as said magnet roll rotates, said alternating electrical field and alternating magnetic field causing an oscillation of said developer between said image carrier and said sleeve;

wherein said magnet roll is rotated at such a speed that the alternating magnetic field created thereby has a frequency which allows said alternating magnetic field to be applied to said developer brush at least once while the same portion of said developer brush is kept in contact with said image carrier; and wherein said alternating electrical field is applied between said image carrier and said sleeve with a frequency which does not cause a beating phenomenon with said alternating magnetic field.

2. A method for developing electrostatic latent images according to claim 1, further comprising the step of rotating said sleeve with respect to said magnet roll at a speed higher than the speed of movement of the developer, said speed of movement of the developer being the speed at which the developer tends to move on the surface of the sleeve due to the magnetic field created by the magnet roll.

* * * * *